US007999687B1

(12) United States Patent
Mickelsen

(10) Patent No.: US 7,999,687 B1
(45) Date of Patent: Aug. 16, 2011

(54) ALARM SYSTEM FOR CEMENT TRUCKS

(76) Inventor: Jamie D. Mickelsen, West Valley City, UT (US)

( * ) Notice: Subject to any disclaimer, the term of this patent is extended or adjusted under 35 U.S.C. 154(b) by 391 days.

(21) Appl. No.: 12/243,109

(22) Filed: Oct. 1, 2008

Related U.S. Application Data

(63) Continuation-in-part of application No. 11/759,328, filed on Jun. 7, 2007, now abandoned.

(51) Int. Cl.
*G08B 21/00* (2006.01)

(52) U.S. Cl. ..... 340/604; 340/540

(58) Field of Classification Search ..... 340/604, 340/603, 618; 73/1.73
See application file for complete search history.

(56) References Cited

U.S. PATENT DOCUMENTS

| | | | | |
|---|---|---|---|---|
| 3,129,928 | A | 4/1964 | Huntington | |
| 3,593,966 | A | 7/1971 | Munroe | |
| 4,544,275 | A | 10/1985 | Hudelmaier | |
| 5,137,365 | A | 8/1992 | Westrich | |
| 7,345,589 | B2 * | 3/2008 | Ehrlich | 340/603 |
| 2004/0128034 | A1 | 7/2004 | Lenker et al. | |
| 2007/0018835 | A1 * | 1/2007 | Ehrlich | 340/603 |
| 2007/0064518 | A1 | 3/2007 | Goff et al. | |

* cited by examiner

*Primary Examiner* — Travis Hunnings
(74) *Attorney, Agent, or Firm* — Marian J. Furst

(57) ABSTRACT

Alarm system for a cement truck providing an audible, or visible, other sensory alarm when water is flowing between the water tank and the mixing barrel. A method is also provided for generating an alarm signal when water is flowing between the water tank and the mixing barrel. The alarm system may be provided as a kit for retrofitting an existing cement truck.

19 Claims, 7 Drawing Sheets

ALARM SYSTEM FOR CEMENT TRUCKS

CROSS-REFERENCE TO RELATED APPLICATIONS

This application is a continuation-in-part of U.S. patent application Ser. No. 11/759,328, filed Jun. 7, 2007 now abandoned, entitled "Alarm System for Cement Trucks," invented by Jamie D. Mickelsen, which is incorporated herein by reference in its entirety.

FIELD OF THE INVENTION

The present invention relates generally to an alarm for the water flow line in a cement mixer truck, and more specifically to an alarm that provides an audible and/or visible signal that water is flowing into the barrel of the truck.

BACKGROUND OF THE INVENTION

Concrete structures are often formed in situ by pouring a cementitious slurry into forms and allowing the slurry to cure into a solid concrete. The slurry composition is formulated based on the desired properties for the structure being formed with the cement. For example, a sidewalk, a highway, and a foundation for a high-rise building would have different strength and load requirements. Also, it may be desirable to control the viscosity of the slurry, depending on whether the slurry is to be poured adjacent the truck or if it must be pumped some distance, such as from the street to the back of a building, as well as how quickly the slurry should solidify and cure. It is important to formulate the slurry appropriately, including adding the correct quantity of water to the dry materials to obtain a concrete mixture with the desired viscosity and curing properties.

Commonly, cement trucks are used to prepare and deliver cement slurries to construction sites. The trucks generally include a rotatable barrel in which water, cement, sand or gravel, and other additives are mixed. Underneath the barrel, there is a pressurized water tank, and a pipeline connects the water tank to the barrel. A valve in the pipeline controls the amount of water added to the solid materials in the barrel. Generally, the valve is manually operated, with a gauge or other visual indicator located inside the cab of the truck showing the volume of water delivered to the barrel or the viscosity of the mixture in the barrel. Some newer model trucks include electrically operated solenoid valves.

However, the gauge or other indicator in the cab only provides information to the truck operator when the operator pays attention to it. It is easy for an operator to get distracted from watching the gauge, such as by a phone call, a conversation, or becoming lost in thought, thus allowing too much water to flow into the barrel. If too much water is added, the slurry is ruined and must be discarded. As a result, additional materials are needed for a new load of cement and additives, and construction may be delayed while the operator drives to the source of the dry materials, reloads the barrel and the water tank, and returns to the construction site. Further, the use of additional materials increases project costs.

The amount of water needed for each job is variable, depending on the quantity of dry materials, the moisture content of the dry materials, and the requirements of the particular job. Thus, it difficult to predict the amount of water needed and, therefore, also difficult to set up a reliable automated control system for water flow. Thus, there is a need for an additional system to aid in preventing the addition of excessive quantities of water to cement slurries.

SUMMARY OF THE INVENTION

To achieve the foregoing and other objects and in accordance with the purpose of the present invention broadly described herein, one embodiment of this invention comprises an alarm system for a cement truck water line wherein the water line includes a valve for controlling water flow between a water tank and a mixing barrel. The system comprises a branched conduit positioned in the water line between the valve and the mixing barrel, a pressure sensor positioned at least partly within the branch water line and responsive to a condition correlated with water flowing through the water line, an alarm for providing a signal triggered when the sensor responds to the condition, means for providing power for the alarm, and means for communicating a response of the sensor to the alarm. The sensor may be an electrical switch responsive to water pressure in the branch line. Preferably, the switch operates between an open circuit when water is not flowing through the water line between the valve and the mixing barrel and a closed circuit when water is flowing through the water line. The alarm may provide a signal detectable by a human sense selected from vision, hearing, touch, and combinations thereof. The means for providing power may be an electrical power source selected from an ignition system of the truck, a battery, a generator, a power source external to the truck, or a combination thereof. The means for communicating a response may be selected from electrical conductors, wireless transmitters and receivers, and combinations thereof. The alarm may be located outside the truck, inside a cab of the truck, or both.

Another embodiment of the invention comprises a method for preventing the addition of excessive quantities of water to a mixing barrel of a cement truck via a water line connecting a water source and the mixing barrel, wherein the water line includes a valve for controlling water flow. The method comprises the steps of providing a sensor positioned between at least partially within a branch water line between the valve and the mixing barrel, with the sensor responsive to a condition correlated with water flowing through the water line; providing an alarm for generating an alarm signal triggered when the sensor responds to the condition; providing power for the alarm signal, and providing means for communicating an alarm response of the sensor to the alarm when water is flowing from the water source into the barrel. Preferably, the sensor is a pressure activate switch. The alarm signal may be selected from audible signals, visible signals, tactile signals, and combinations thereof.

Yet another embodiment of the present invention comprises a kit for retrofitting a cement truck with an alarm system for the truck water line, wherein the water line includes a valve for controlling water flow between a water tank and a mixing barrel. The kit includes a branched conduit insertable into the cement truck water line between the valve and the mixing barrel; a sensor positionable at least partly within the branch of the conduit and responsive to a condition correlated with water flowing through the water line; an alarm for providing a signal triggered when the sensor responds to the condition, means for providing power for the alarm; and means for communicating a response of the sensor to the alarm. Preferably, the valve is a ball valve, and the sensor is a pressure-activated switch activated by the valve handle. The means for providing power and the means for communicating may comprise electrically conductive wires. The alarm may be selected from devices that produce audible signals, visible signals, tactile signals, and combinations thereof.

BRIEF DESCRIPTION OF THE DRAWINGS

These and other features, aspects, and advantages of the present invention will become better understood with reference to the following description, appended claims, and accompanying drawings, where:

DESCRIPTION OF THE PREFERRED EMBODIMENT

Figure 1:
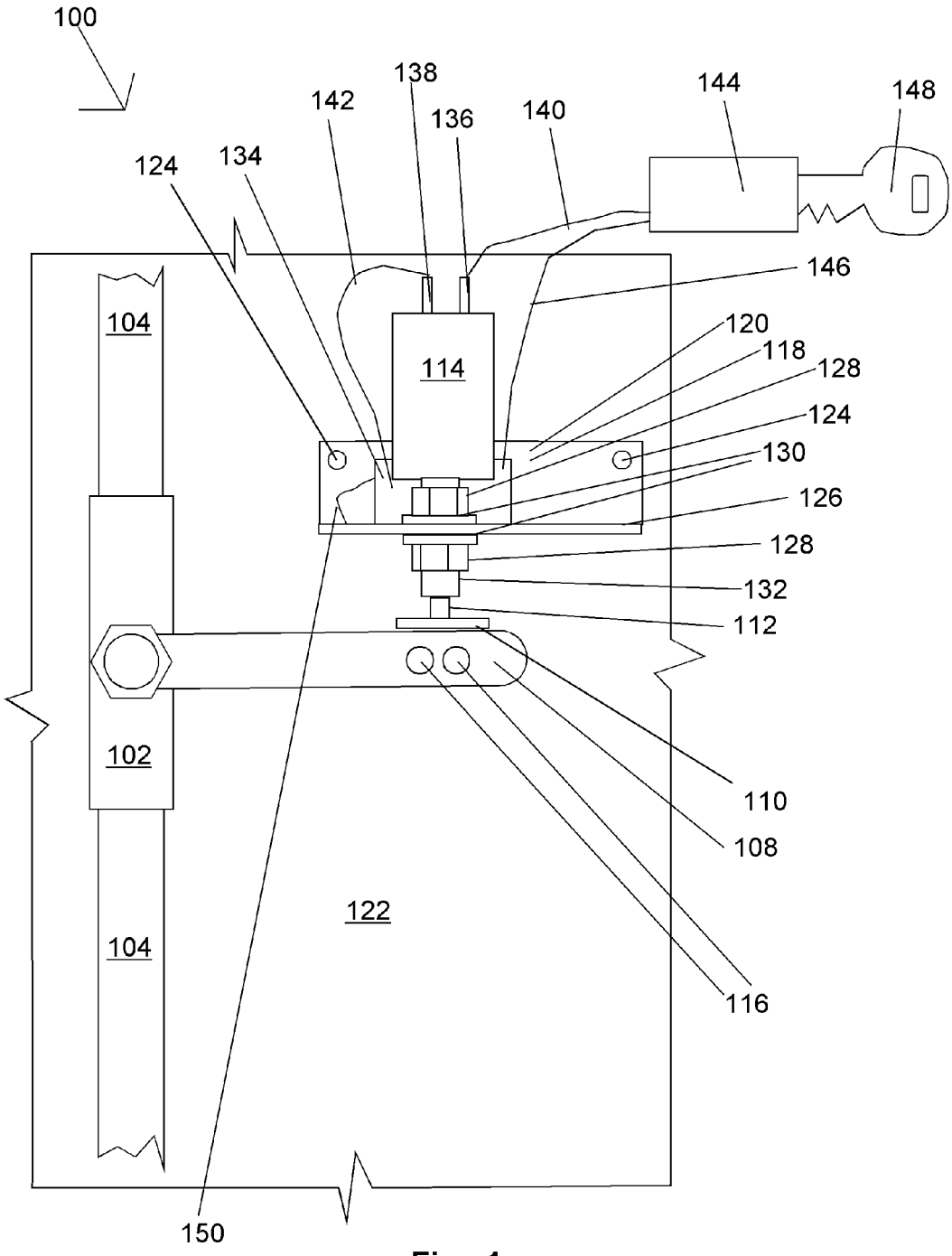
FIG. 1 is a schematic drawing showing an alarm system in accordance with the present invention with the water valve closed.

The present invention comprises a system and method for alerting a cement truck operator that water is flowing through the pipeline connecting the water tank and the mixing barrel of the cement truck. The system includes a sensor that detects when water is flowing or a switch that closes an electrical circuit when water is flowing. It also includes an alarm, such as an audible signal, a light, a tactile stimulator, or a combination thereof. An alarm system in accordance with the present invention may be retrofitted to an existing cement truck or incorporated into a new truck.

FIGS. 1-4 show an alarm system 100 suitable for use with a ball valve 102 for controlling flow through a water pipe 104 that connects a pressurized water tank (not shown) and the cement mixing barrel (not shown). Arrows 106 indicate the water flow direction. Ball valve 102 is opened and closed by means of valve handle 108. Switch contact plate 110 is attached to handle 108 at a position where it can engage piston 112 of pressure-activated switch 114. Fasteners 116, shown as screws, are used to secure plate 110 to handle 108, allowing an existing valve handle to be modified to work in accordance with the present invention. However, other means of attachment could be used, such as but not limited to welding, bonding, or forming the handle with an integral plate.

Bracket 118 includes a mounting member 120, secured to the rear outer wall 122 of the truck cab with fasteners 124 or another suitable attachment means, and a switch retaining member 126 extending outward from the cab wall 122. Pressure-activated switch 114 is secured to retaining member 126, for example as shown with nuts 128 and washers 130 on threaded shaft 132 sandwiching the switch retaining member 126. Switch 114 includes a piston 112 that is reciprocally slidable within threaded shaft 132, with the reciprocal motion toward and away from switch body 130. Alarm speaker 134 is also mounted onto retaining member 126 of bracket 118. Electrical contacts 136 and 138 are connected by wires 140 and 142 to the truck ignition 144 and to alarm speaker 134, respectively. Wire 146 provides electrical communication between speaker 134 and truck ignition 144 to provide for a complete electrical circuit.

Figure 2:
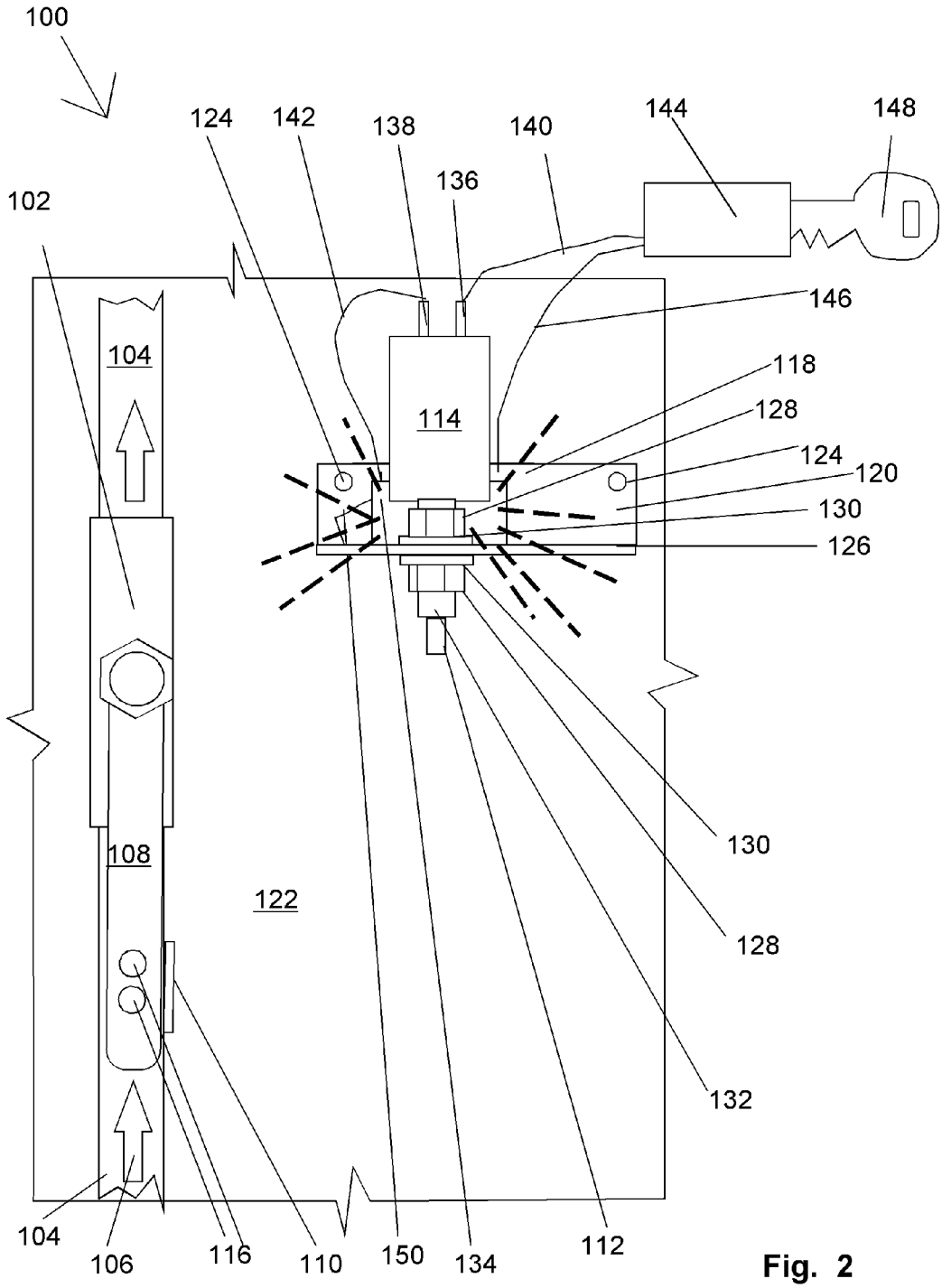
FIG. 2 is a schematic drawing showing the alarm system of FIG. 1 with the water valve open.

When the ignition key 148 is positioned to provide current through the truck ignition system, switch 114 and alarm speaker 134 are also provided with current when piston 112 extends maximally outward from switch body 130. Referring to FIG. 1, if piston 112 is pressed toward switch body 130, such as by rotating valve handle 108 such that plate 110 engages the end of piston 112 to close valve 102, the electrical circuit through switch 114 is opened. If piston 112 is extended, as shown in FIG. 2, the circuit is complete and current flows to activate alarm speaker 134. Thus, when valve 102 is open and water is flowing through pipe 104 into the mixing barrel, the alarm system 100 creates an audible signal to alert the operator that water is flowing.

Figure 3:
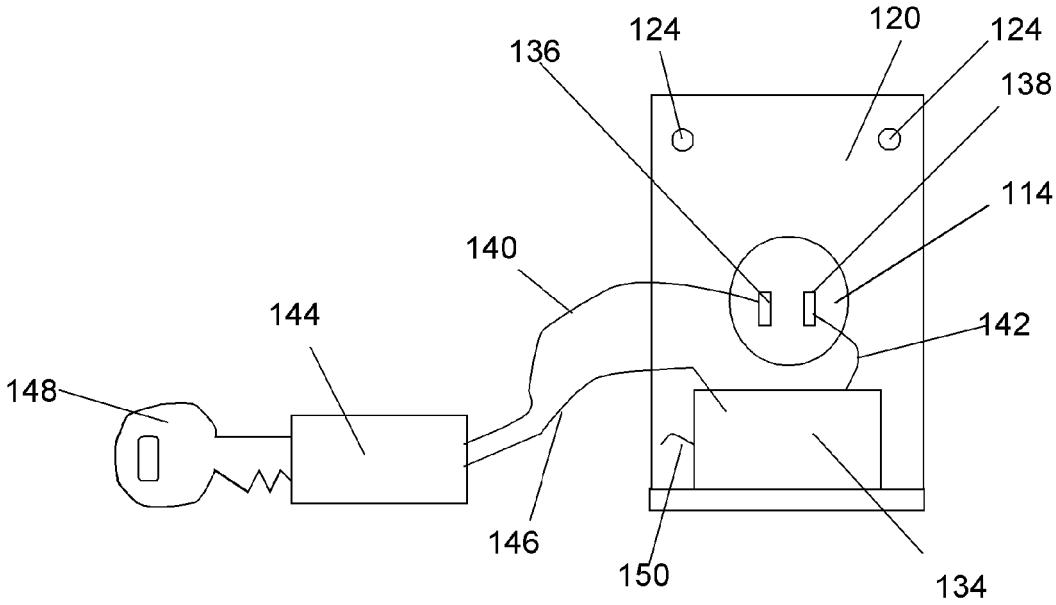
FIG. 3 is a schematic drawing showing the alarm system of FIG. 1 from the top.
Figure 4:
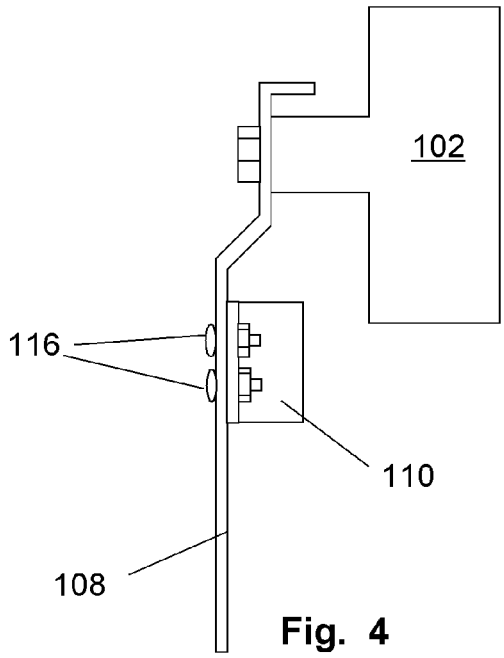
FIG. 4 is a side view of the ball valve and handle in accordance with the present invention.

As shown in FIGS. 1-3, alarm speaker 134 is mounted on bracket 118, with ground wire 150 extending between speaker 134 and bracket 118. Alternatively, an alarm speaker could be mounted elsewhere, such as inside the truck cab, as long as it will be audible by the truck operator. Preferably, the alarm sound is somewhat unpleasant and audible in the general vicinity of the truck, thereby directing the operator's attention to the water flowing into the mixing barrel. If the alarm speaker is outside the cab, as shown, it should be loud enough to be heard easily inside the cab.

Figure 5:
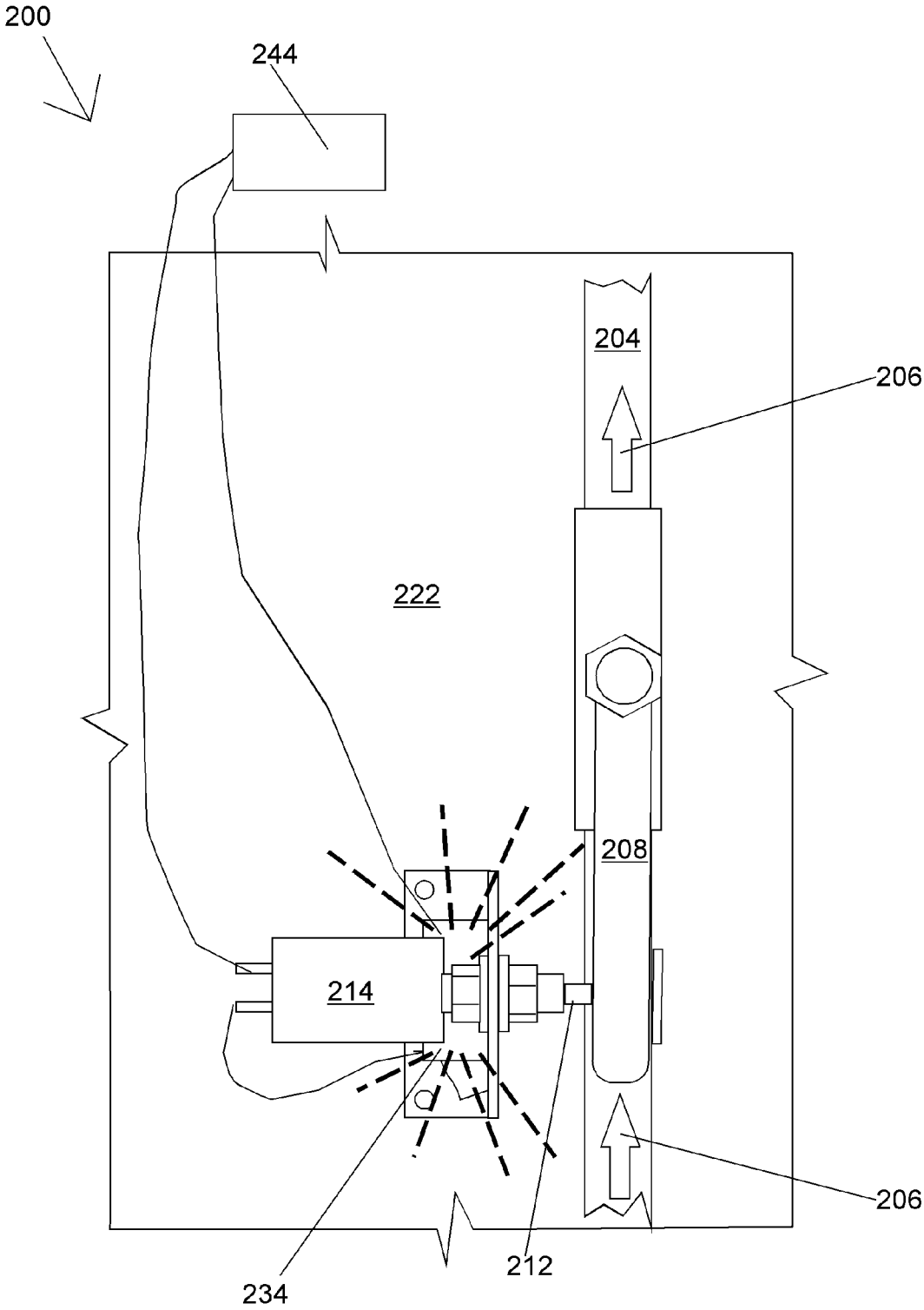
FIG. 5 is a schematic drawing showing another alarm system in accordance with the present invention with an open water valve.

Referring to FIG. 5, another embodiment 200 of an alarm system in accordance with the present invention includes a switch 214 having a pressure-sensitive component 212 that closes the circuit when the valve handle 208 is positioned so that the valve is open, allowing water to flow through pipe 204 into the mixing barrel. Arrows 206 indicate the flow direction. Power for the electrical circuit is provided by a power source 244, which may be the truck's ignition, a separate battery, or any other appropriate power source. When the circuit is closed, alarm speaker 234 produces a loud and, preferably, somewhat unpleasant noise. Switch 214 may be mounted to the back of the truck cab 222, such with a mounting bracket 218. This embodiment is less desirable than the embodiment shown in FIGS. 1-3, because the speaker 234 would be activated when the valve is fully open, but would not necessarily be activated if the valve is only partially open, whether due to an operator inadvertently leaving the valve partially open or due to a deliberate attempt to avoid the reminder sound of the speaker while water is flowing.

Rather than using a pressure-sensitive switch outside the valve, requiring a valve handle or other external part that moves to open or close the valve, a pressure sensor or flow sensor can be installed inside the water pipeline, preferably between the valve and the mixing barrel. This is desirable for use with cement trucks equipped with solenoid valves having no external moving parts.

Figure 6:
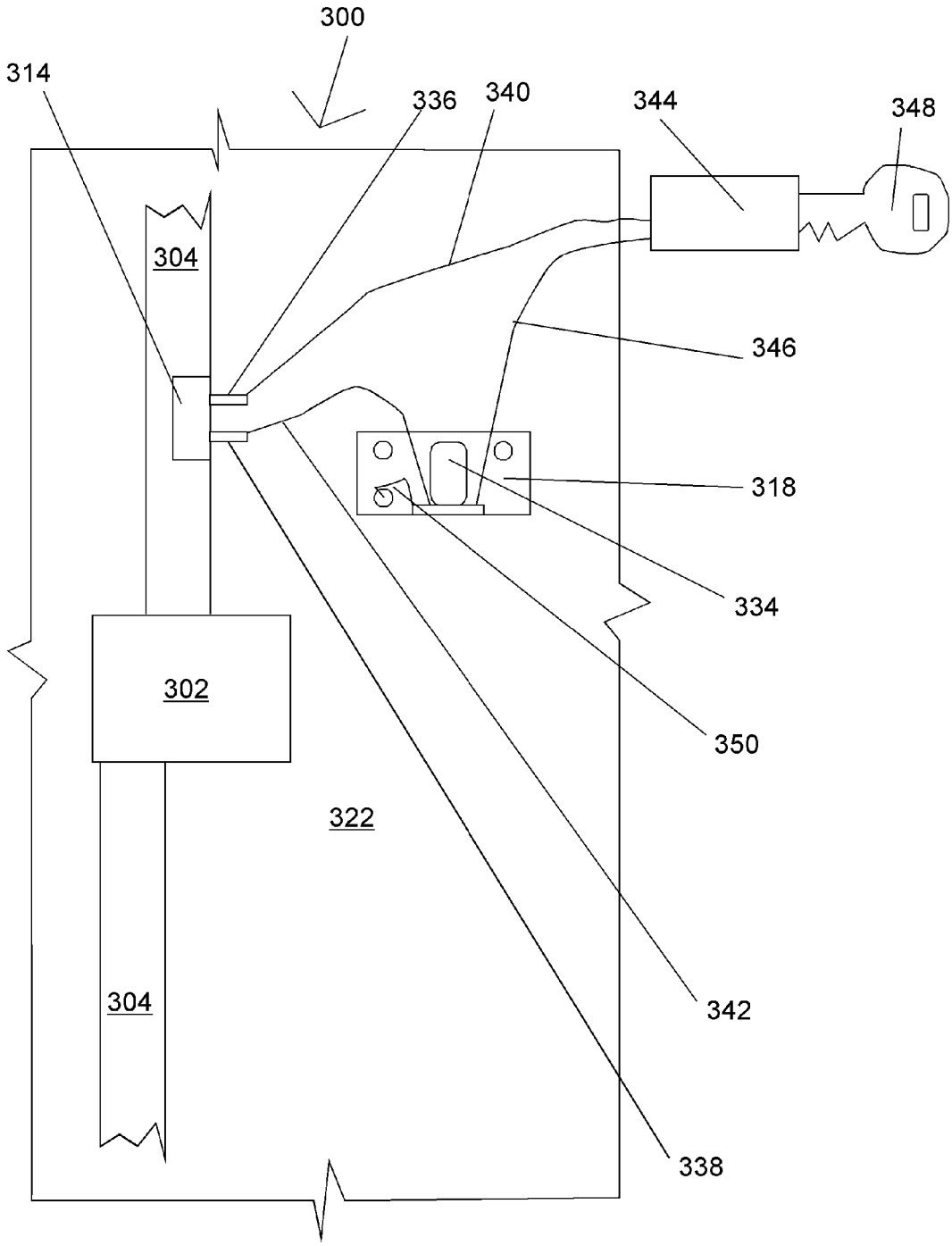
FIG. 6 is a schematic drawing of yet another alarm system in accordance with the present invention with the water valve closed.
Figure 7:
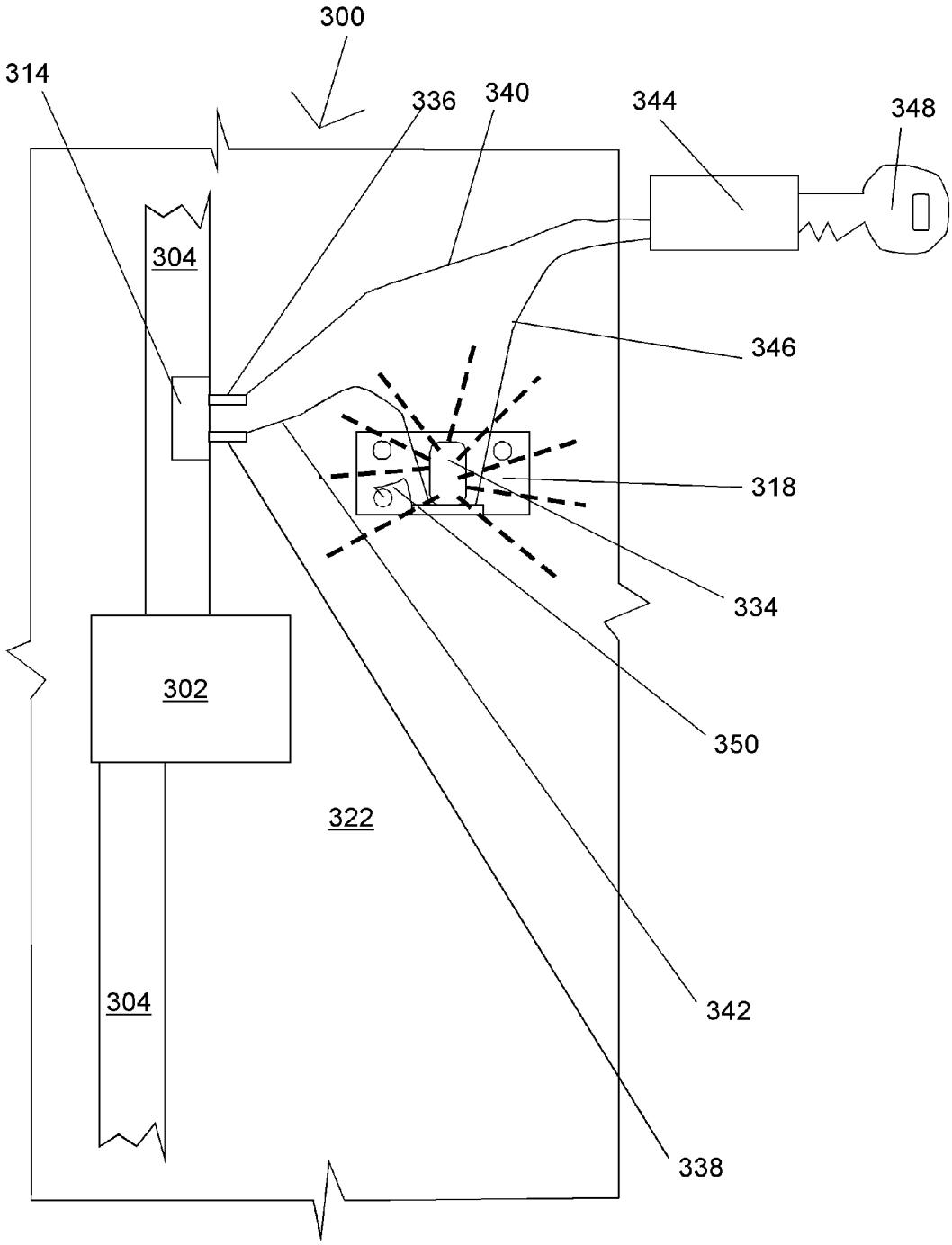
FIG. 7 is a schematic drawing showing the alarm system of FIG. 6 with the water valve open.

Thus, another embodiment 300 of the present invention, shown schematically in FIGS. 6 and 7, is suitable for use with any type of valve. Pipeline 304 provides a fluid conduit between the water tank and the mixing barrel, with valve 302 for controlling the flow, shown with arrows 306 in FIG. 7. Pressure or flow sensor 314 is mounted within pipeline 304 and has electrical contacts 336 and 338 extending outside of pipeline 304. Wire 340 between contact 336 and the truck ignition 344, wire 342 between contact 338 and a visible alarm, such as a light emitter 334, and wire 346 between alarm 334 and truck ignition 344 form an electrical circuit, with pressure or flow sensor 314 operating as a switch. Light emitter 334 may be mounted onto the exterior surface of the back wall of truck cab 322 with a mounting bracket 318, as shown. Preferably, the system includes an electrical ground, such as ground wire 350. Any type of light emitter, for example a light bulb or an LED, could be used, and the light could be continuous or flashing. Preferably, it is bright enough to be readily noticed by the truck operator.

Figure 8:
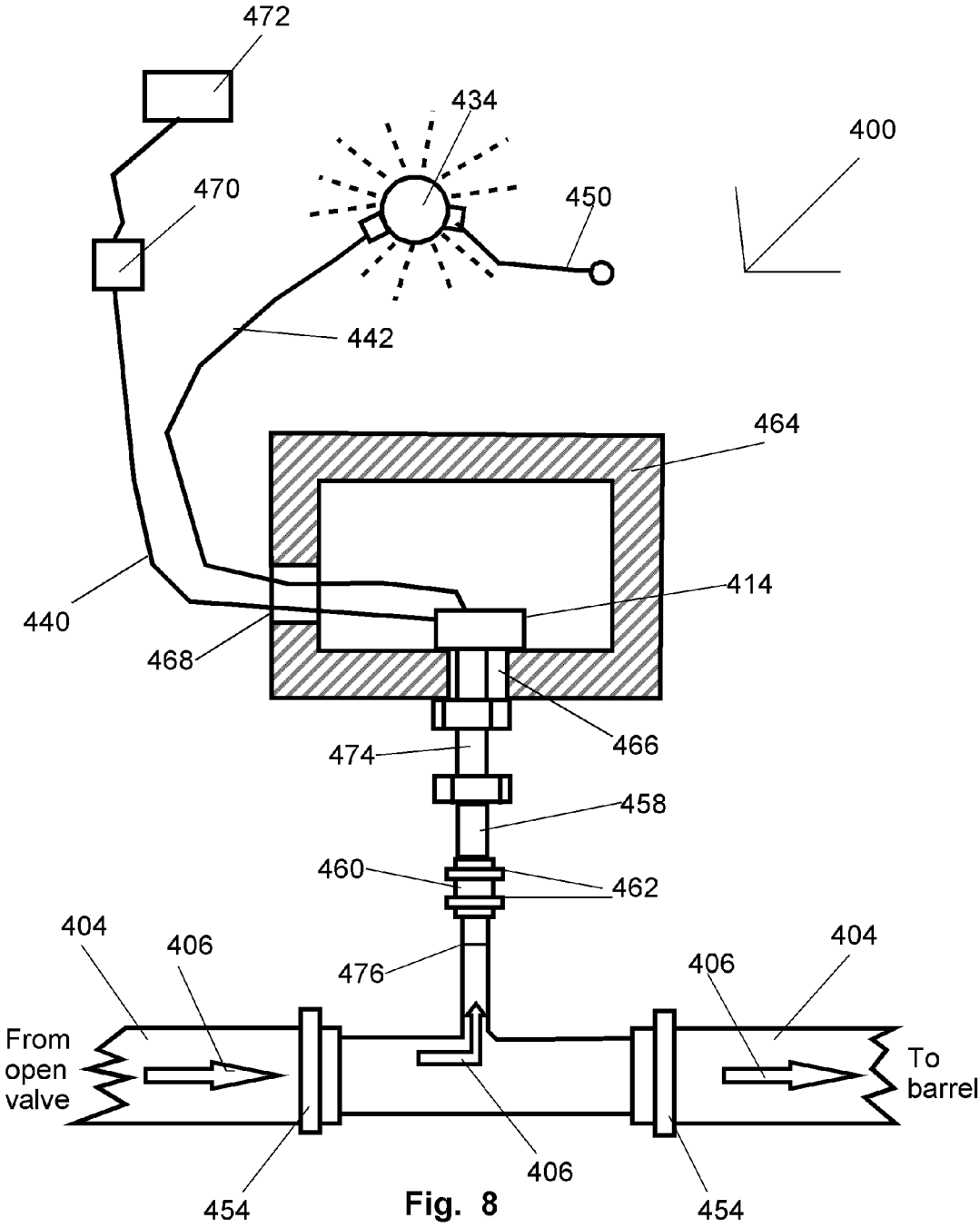
FIG. 8 is a schematic drawing of still another alarm system in accordance with the present invention with the water valve open.

Referring to FIG. 8, embodiment 400 includes a branched conduit 452 inserted into pipeline 404 between the valve (not shown) and the mixing barrel (not shown), with the arrows 406 showing the main water flow direction. Hose clamps 454 seal pipeline 404 about the ends of conduit 452. Side branch 456 is connected to bushing 458 via tubing 460 and hose clamps 462. Pressure switch 414 is mounted inside housing 464 and connected through opening 466 to bushing 458. Electrical wire 440 passes through opening 468 in housing 464 and connects pressure switch contact 436 to the fuse link 470 and truck fuse box 472, and wire 442 connects pressure switch contact 438 to alarm 434. Alternatively, contact 436 could be connected to the truck ignition, not shown. Placement of the sensor in branch 454 allows the detection of pressure when valve 402 is open and water is flowing through line 404, without impeding water flow. Housing 464 can be mounted onto the cement truck by any suitable means known in the art, such as with adhesive or bolts. If retrofitting of an existing water line is desired, branched conduit 452 can easily be spliced into or inserted along pipeline 404. It should be noted that the side branch 456 is a closed-end tube. Thus, the section 474 of branch 456 between water/air interface 476 and pressure switch 414 is filled with air at all times, including when water is flowing through pipeline 404. Pressure switch 414 is responsive to air pressure changes resulting from the flow of water through pipeline 404.

Generally, the mixing barrel is rotating while being charged with water, and the truck ignition must be switched on to provide power to rotate the barrel. Thus, the truck ignition will be switched on whenever the alarm is needed, and it is preferable to power the alarm system of the present invention via the truck ignition switch. However, another power source could be used, such as an independent battery or an external electrical source such as a generator or electrical outlet and cord.

For simplicity, the embodiments illustrated in FIGS. 1-8 show the speaker or light emitter mounted to the outside rear wall of the truck cab. Alternatively, they could be mounted inside the cab or elsewhere on the truck, as long as they are positioned to provide readily noticeable signals to the operator. Multiple speakers and/or light emitters could be used, or a combination of a speaker and a light emitter, to ensure that the alarm will be noticed. The speaker(s) and/or light emitter (s) may be activated via electrical wires, as shown, or, alternatively, they may be activated by a wireless signal transmission between the sensor and the speaker, such as an optical or radio frequency signal. Particularly if a wireless transmission method is used, it may also be desirable to provide an alarm signal to a tactile stimulus, such as a vibrator. It may be desirable to combine more than one signal, such as multiple speakers, multiple lights, multiple tactile devices, or combinations of two or more different types of devices. In any case, it is important that the alarm signal is sufficiently unpleasant or stimulating that it will provide notice to the operator that water is flowing into the mixing barrel. The signal should not be one that is easily "tuned out" by the operator, lest he or she become distracted and forget to close the valve when the proper amount of water has been added to the mixing barrel.

Any pressure-activated switch or flow detector may be used that operates under the reasonably anticipated conditions in the operation of the cement truck, including the vibration expected during transit and while mixing and pouring cement. Also, any alarm device, such as a speaker, light, or tactile device may be used, as long as it will operate under reasonable anticipated conditions for transportation, mixing, and pouring of cement.

The foregoing description is considered as illustrative only of the principles of the invention. Further, since numerous modifications and changes will readily occur to those skilled in the art, it is not desired to limit the invention to the exact construction and process shown and described above. Accordingly, all suitable modifications and equivalents may be resorted to falling within the scope of the invention.

What is claimed is:

1. An alarm system for a cement truck water line, the water line including a valve for controlling water flow between a water tank and a mixing barrel, the system comprising:

a conduit branch extending from the water line, a sensor positioned at least partly within said conduit branch, wherein said sensor is responsive to responsive to a condition correlated with water flowing through the water line;

an alarm for providing a signal triggered when said sensor responds to a change in the condition in the water line;

means for providing power for said alarm; and means for communicating a response of said sensor to said alarm.

2. The alarm system of claim 1, wherein said alarm provides a signal detectable by a human sense selected from vision, hearing, touch, and combinations thereof.

3. The alarm system of claim 1, wherein said means for providing power is an electrical power source selected from an ignition system of the truck, batteries, generators, power sources external to the truck, and combinations thereof.

4. The alarm system of claim 1, wherein said means for communicating a response is selected from electrical conductors, wireless transmitters and receivers, and combinations thereof.

5. The alarm system of claim 1, wherein said alarm is located outside the truck, inside a cab of the truck, or a combination thereof.

6. The alarm system of claim 1, wherein said sensor is a pressure-activated switch.

7. The alarm system of claim 6, wherein said switch is operable between a closed position at higher water pressure and an open position at lower water pressure.

8. The alarm system of claim 1, wherein said branch conduit is positioned in the water line between the valve and the mixing barrel.

9. The alarm system of claim 1, wherein said sensor is selected from switches responsive to water pressure in said conduit branch, switches responsive to water flow in said conduit branch, switches responsive to changes in air pressure in said conduit branch, and combinations thereof.

10. The alarm system of claim 1, wherein said alarm is located outside the truck, inside a cab of the truck, or a combination thereof.

11. A method for preventing the addition of excessive quantities of water to a mixing barrel of a cement truck via a water line connecting a water source and the mixing barrel, the water line including a valve for controlling water flow, said method comprising the steps of:

providing a sensor responsive to a condition correlated with water flowing through the water line, said sensor positioned at least partly within a a branch of a conduit positioned in the water line;

wherein said sensor is responsive to responsive to a condition correlated with water flowing through the water line;

providing an alarm for generating an alarm signal triggered when said sensor responds to the condition, said signal selected from audible signals, visible signals, tactile signals, and combinations thereof;

providing power for said alarm signal; and providing means for communicating an alarm response of said sensor to said alarm when water is flowing from the water source into the barrel.

12. The method of claim 11, wherein said sensor is positioned in said branch of said conduit and selected from pressure activated switches, flow detecting devices, and combinations thereof.

13. The method of claim 11, wherein said alarm signal is selected from audible signals, visible signals, tactile signals, and combinations thereof.

14. A kit for retrofitting a cement truck with an alarm system for a cement truck water line, said kit comprising:

a branched conduit insertable into the cement truck water line;

means for joining ends of said conduit to the truck water line;

a pressure sensor positionable at least partly within said branch of said conduit and responsive to a condition correlated with water flowing through the water line;

an alarm for providing a signal triggered when said sensor responds to the condition;

means for providing power for said alarm; and means for communicating a response of said sensor to said alarm.

15. The kit of claim 14, wherein said means for providing power and said means for communicating comprise electrically conductive wires.

16. The kit of claim 14, wherein said alarm is selected from devices that produce audible signals, visible signals, tactile signals, and combinations thereof.

17. The kit of claim 14, wherein said means for communicating is selected from electrical conductors, wireless transmitters and receivers, and combinations thereof.

18. The kit of claim 14, wherein said means for joining comprises hose clamps.

19. The kit of claim 14, wherein said branched conduit is insertable into the cement truck water line between the valve and the mixing barrel, and said pressure sensor is responsive to changes in air pressure.

* * * * *